US009422094B2

(12) United States Patent
Niiro et al.

(10) Patent No.: US 9,422,094 B2
(45) Date of Patent: Aug. 23, 2016

(54) PACKAGING FOR HEADPHONES, PACKAGED HEADPHONES, AND RELATED METHODS

(71) Applicant: Skullcandy, Inc., Park City, UT (US)

(72) Inventors: Mark T. Niiro, Park City, UT (US); Xuan Shu, San Francisco, CA (US); Joshua Brent Poulsen, Park City, UT (US); Kevin Sze, Salt Lake City, UT (US)

(73) Assignee: Skullcandy, Inc., Park City, UT (US)

( * ) Notice: Subject to any disclaimer, the term of this patent is extended or adjusted under 35 U.S.C. 154(b) by 282 days.

(21) Appl. No.: 13/678,394

(22) Filed: Nov. 15, 2012

(65) Prior Publication Data

US 2013/0118944 A1 May 16, 2013

Related U.S. Application Data

(60) Provisional application No. 61/560,156, filed on Nov. 15, 2011.

(51) Int. Cl.

| | |
|---|---|
| ***B65D 5/00*** | (2006.01) |
| ***B65D 73/02*** | (2006.01) |
| ***B65B 5/02*** | (2006.01) |
| ***B65D 5/42*** | (2006.01) |
| ***B65D 5/50*** | (2006.01) |

(52) U.S. Cl.

CPC ..... *B65D 73/02* (2013.01); *B65B 5/024* (2013.01); *B65D 5/4204* (2013.01); *B65D 5/5088* (2013.01)

(58) Field of Classification Search

CPC ..... B65D 5/00; B65D 5/42; B65D 85/30; B65D 5/322; B65D 5/38; B65D 5/4204

USPC ..... 206/320, 471, 577, 736, 770, 769, 206/304.1, 304.2, 314, 352, 379, 776, 781, 206/782, 485, 488, 521.8, 591, 592

See application file for complete search history.

(56) References Cited

U.S. PATENT DOCUMENTS

| | | | | | |
|---|---|---|---|---|---|
| 4,134,493 | A | * | 1/1979 | Cech | 206/756 |
| 4,908,742 | A | * | 3/1990 | Kersey | 362/156 |
| D313,753 | S | * | 1/1991 | Nagasaka | D9/415 |
| D321,323 | S | * | 11/1991 | Nakamura | D9/415 |
| 5,272,856 | A | | 12/1993 | Pharo | |
| D348,391 | S | * | 7/1994 | Ichikawa et al. | D9/415 |
| 5,487,470 | A | | 1/1996 | Pharo | |

(Continued)

FOREIGN PATENT DOCUMENTS

| | | | |
|---|---|---|---|
| CA | 2515558 | A1 | 2/2007 |
| CA | 2697029 | A1 | 2/2007 |

(Continued)

*Primary Examiner* — Anthony Stashick
*Assistant Examiner* — Ernesto Grano
(74) *Attorney, Agent, or Firm* — TraskBritt

(57) ABSTRACT

Packaging inserts for headphones include a unitary body having two or more integral portions configured to fold relative to one another so as to partially enclose, support, and retain a headphone within the folded unitary body between the integral portions. Methods of packaging headphones include positioning a headphone on such a unitary body, and folding the unitary body around at least a portion of the headphones. Packaged headphone assemblies include a headphone, and such a packaging insert folded around at least a portion of the headphone.

17 Claims, 7 Drawing Sheets

(56) References Cited

U.S. PATENT DOCUMENTS

| | | | | | |
|---|---|---|---|---|---|
| 5,806,683 | A * | 9/1998 | Gale | 206/587 |
| 5,887,720 | A * | 3/1999 | Lin | 206/702 |
| D415,679 | S * | 10/1999 | Hata | D9/415 |
| 5,984,103 | A * | 11/1999 | Stirmel et al. | 206/722 |
| 6,006,915 | A * | 12/1999 | Moor | 206/579 |
| D433,937 | S * | 11/2000 | Glassman | D9/415 |
| 6,170,663 | B1 | 1/2001 | Glassman | |
| 6,672,456 | B2 | 1/2004 | Russell | |
| 6,848,285 | B2 | 2/2005 | Stroh | |
| 6,914,995 | B2 * | 7/2005 | Kao | 381/370 |
| 6,978,585 | B2 | 12/2005 | Russell | |
| 7,187,948 | B2 | 3/2007 | Alden | |
| 7,395,090 | B2 | 7/2008 | Alden | |
| D604,501 | S * | 11/2009 | Lee | D3/201 |
| 7,643,645 | B2 | 1/2010 | Richards | |
| D609,085 | S * | 2/2010 | Brachman et al. | D9/415 |
| D623,627 | S | 9/2010 | Alden et al. | |
| D624,057 | S | 9/2010 | Kelly et al. | |
| 7,854,373 | B2 * | 12/2010 | Chen | 229/162.2 |
| 7,866,478 | B2 * | 1/2011 | Rohrbach et al. | 206/586 |
| D641,003 | S | 7/2011 | Alden | |
| 8,014,824 | B2 | 9/2011 | Alden | |
| D650,356 | S | 12/2011 | Alden et al. | |
| D656,129 | S | 3/2012 | Kelly et al. | |
| D665,776 | S | 8/2012 | Alden et al. | |
| D665,777 | S | 8/2012 | Alden et al. | |
| D673,136 | S | 12/2012 | Kelly et al. | |
| D673,140 | S | 12/2012 | Kelly et al. | |
| D674,372 | S | 1/2013 | Kelly et al. | |
| D674,376 | S | 1/2013 | Kelly et al. | |
| D676,023 | S | 2/2013 | Kelly et al. | |
| D676,024 | S | 2/2013 | Kelly et al. | |
| D677,241 | S | 3/2013 | Kelly et al. | |
| D683,618 | S * | 6/2013 | Shirosawa | D9/424 |
| D683,717 | S | 6/2013 | Kelly et al. | |
| 8,457,557 | B2 | 6/2013 | Alden | |
| D685,759 | S | 7/2013 | Kelly et al. | |
| D685,767 | S | 7/2013 | Kelly et al. | |
| 8,515,115 | B2 | 8/2013 | Kelly et al. | |
| D689,464 | S | 9/2013 | Bonahoom et al. | |
| 8,542,859 | B2 | 9/2013 | Alden | |
| D691,372 | S * | 10/2013 | Chun | D3/294 |
| D691,582 | S | 10/2013 | Nguyen et al. | |
| D693,793 | S | 11/2013 | Kelly et al. | |
| 8,590,703 | B2 * | 11/2013 | Tierney et al. | 206/320 |
| 8,607,987 | B2 * | 12/2013 | Oja et al. | 206/776 |
| D699,216 | S | 2/2014 | Bonahoom et al. | |
| D701,193 | S | 3/2014 | Kelly et al. | |
| D701,196 | S | 3/2014 | Kelly et al. | |
| D701,197 | S | 3/2014 | Kelly et al. | |
| 2002/0189203 | A1 | 12/2002 | Russell | |
| 2003/0221464 | A1 | 12/2003 | Stroh | |
| 2004/0083683 | A1 * | 5/2004 | Russell | 53/397 |
| 2006/0001307 | A1 * | 1/2006 | Embach | 297/391 |
| 2006/0126313 | A1 | 6/2006 | Steiner et al. | |
| 2007/0025577 | A1 | 2/2007 | Richards | |
| 2007/0256946 | A1 * | 11/2007 | Godshaw et al. | 206/320 |
| 2008/0137269 | A1 | 6/2008 | Bak et al. | |
| 2009/0101698 | A1 * | 4/2009 | Chen | 229/117.18 |
| 2009/0168088 | A1 | 7/2009 | Rosenblatt | |
| 2010/0155277 | A1 * | 6/2010 | Koch | 206/320 |
| 2010/0181222 | A1 * | 7/2010 | Aiko et al. | 206/461 |
| 2011/0004325 | A1 | 1/2011 | Ayal | |
| 2011/0216932 | A1 | 9/2011 | Wu | |
| 2012/0061272 | A1 * | 3/2012 | Wagner | 206/320 |
| 2012/0275615 | A1 | 11/2012 | Kelly et al. | |
| 2012/0325701 | A1 * | 12/2012 | Debitzky | 206/320 |
| 2013/0118944 | A1 | 5/2013 | Niiro et al. | |
| 2013/0130540 | A1 | 5/2013 | Oman et al. | |
| 2013/0177165 | A1 | 7/2013 | Oishi | |
| 2013/0177195 | A1 | 7/2013 | Sze et al. | |
| 2013/0185905 | A1 | 7/2013 | Stiff et al. | |
| 2013/0208909 | A1 | 8/2013 | Mülder | |
| 2013/0220872 | A1 * | 8/2013 | Stiehl et al. | 206/577 |
| 2013/0233745 | A1 * | 9/2013 | Tierney et al. | 206/320 |
| 2013/0336514 | A1 | 12/2013 | Kelly et al. | |
| 2014/0056459 | A1 | 2/2014 | Oishi et al. | |

FOREIGN PATENT DOCUMENTS

| | | | |
|---|---|---|---|
| EP | 1760896 | A1 | 3/2007 |
| EP | 2262117 | A1 | 12/2010 |
| WO | 2010068495 | A2 | 6/2010 |
| WO | 2010124190 | A2 | 10/2010 |
| WO | 2011085096 | A2 | 7/2011 |
| WO | 2012024656 | A2 | 2/2012 |

* cited by examiner

PACKAGING FOR HEADPHONES, PACKAGED HEADPHONES, AND RELATED METHODS

CROSS-REFERENCE TO RELATED APPLICATION

This application claims the benefit of the filing date of U.S. Provisional Application Ser. No. 61/560,156, filed Nov. 15, 2011 and entitled "Packaging for Headphones, Packaged Headphones, and Related Methods," the disclosure of which application is hereby incorporated herein in its entirety by reference.

FIELD

Embodiments of the disclosure generally relate to packaging structures and assemblies for headphones, and to methods of packaging headphones using such packaging structures and assemblies.

BACKGROUND

Headphones are commonly packaged in different packaging configurations. For example, many headphones are packaged in pockets (such pockets may also be referred to as "bubbles" or "blisters") formed between two plastic sheets of similar size and shape, which are secured together around the periphery of the plastic sheets. Such plastic sheets may be portions of an integral plastic sheet, which is folded over upon itself in a clamshell configuration. This type of packaging is often referred to in the art as "blister packaging." In another packaging configuration, a headphone may be placed in a tray, which then may be inserted in a rectangular box.

BRIEF SUMMARY

In some embodiments, the present disclosure includes a packaging insert for a headphone. The packaging insert includes a unitary body having a first integral portion and a second integral portion adjoining the first integral portion along a fold line. The first integral portion includes a central support feature sized and configured to be disposed within and provide support to a headphone to be packaged using the packaging insert. The second integral portion including a retaining feature sized and configured to cooperate with the central support feature of the first integral portion to retain a portion of a headphone to be packaged using the packaging insert when the first integral portion and the second integral portion are folded relative to one another along the fold line.

In additional embodiments, the present disclosure includes a method of packaging a headphone. A headphone is positioned on a headphone support feature of a packaging insert having a unitary body, and the unitary body is folded along a fold line to rotate an integral end portion of the unitary body relative to the headphone support feature to secure at least a portion of the headphone between the integral end portion and the headphone support feature.

In yet further embodiments, the present disclosure includes a packaged headphone assembly that comprises a packaging insert and a headphone retained within the packaging insert. The packaging insert comprises a unitary body including a first integral portion folded relative to a second integral portion along a fold line there between. The first integral portion includes a central support feature partially surrounded by and supporting the headphone. The second integral portion includes a retaining feature cooperating with the central support feature of the first integral portion to retain a portion of the headphone within the folded unitary body between the first integral portion and the second integral portion.

BRIEF DESCRIPTION OF THE DRAWINGS

The present disclosure may be understood more fully by reference to the following detailed description of example embodiments, which are illustrated in the appended figures in which.

DETAILED DESCRIPTION

The illustrations presented herein are not meant to be actual views of any particular packaging, headphone, or component of packaging or headphones, but are merely idealized representations that are employed to describe embodiments of the present disclosure. Throughout this specification, like reference numbers refer to like elements.

Embodiments of the present disclosure may be used to package headphones in a manner that securely retains the headphones within the packaging, provides physical protection to the headphones from damage during shipment and storage, and that allows at least a portion of the headphones to be visible through the packaging to a consumer. Additionally, the packaging may be relatively easy to open to obtain access to the headphones therein.

In general, embodiments of the disclosure include a packaging insert that comprises a unitary body having two or more integral portions with fold lines between adjacent integral portions. A headphone may be positioned on the packaging insert, and the packaging insert may be folded along the fold line to cause relative movement between the two integral portions of the unitary body. As the packaging insert is folded along the fold line, at least a portion of the headphone is secured and retained between complementary features on the two integral portions of the unitary body. At least a portion of the headphone may be exposed when the headphone is retained in the folded unitary body of the packaging insert. The packaging insert with the headphone retained therein may be inserted into another container, such as a rectangular packaging box. A portion of the container may be transparent to allow at least a portion of the headphone to be viewed through the container when the packaging insert and the headphone retained therein are disposed within the container and the container is closed.

Figure 1:
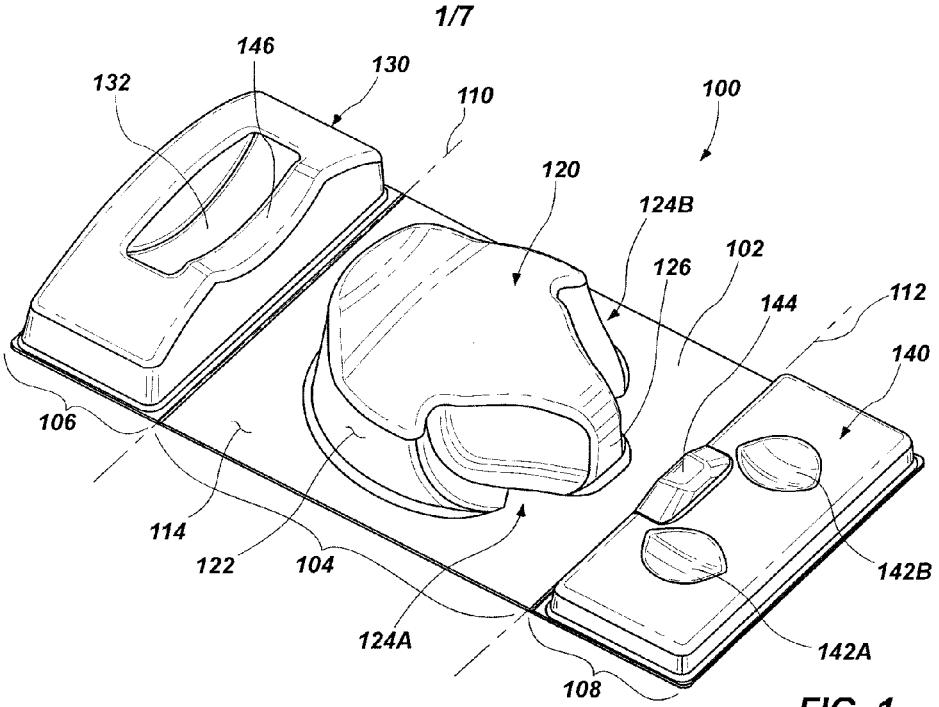
FIG. 1 is a front perspective view of a packaging insert that may be used in packaging of headphones.
Figure 2:
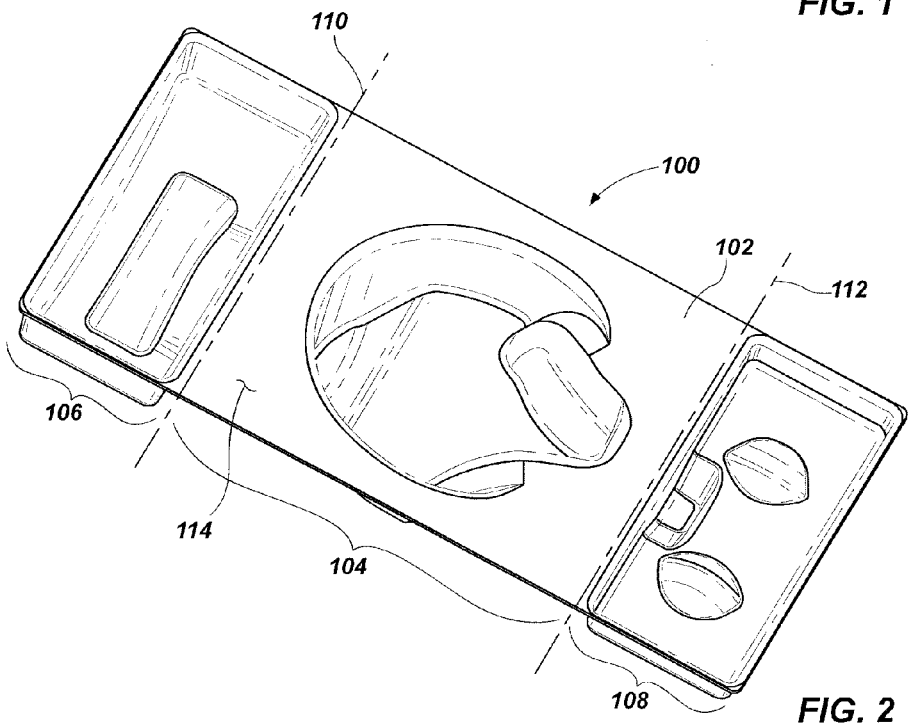
FIG. 2 is a back perspective view of the packaging insert of FIG. 1.
Figure 3:
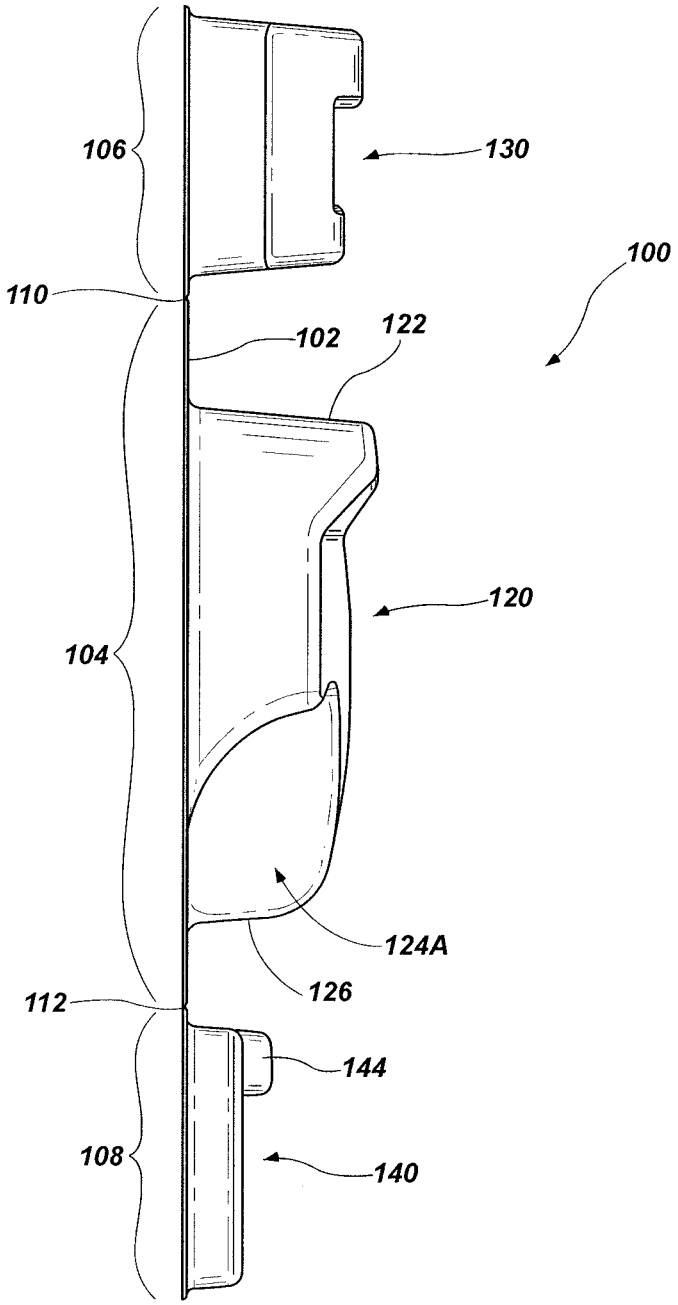
FIG. 3 is a side view of the packaging insert of FIG. 1 in an unfolded configuration.

An example embodiment of such a packaging insert 100 is illustrated in FIGS. 1 through 7. Referring to FIGS. 1 through 3, the packaging insert 100 includes a unitary body 102 having an integral central portion 104, an integral first end portion 106, and an integral second end portion 108. The unitary body 102 may be fabricated from and comprise, for example, a plastic material or a paper-based packaging material (e.g., cardboard, molded paper pulp, etc.). In some embodiments, the material of the unitary body 102 may be recyclable and/or biodegradable.

Optionally, a volume of material that exhibits a reduced coefficient of friction relative to the paper pulp material may be disposed over at least a portion of the unitary body. Such a volume of material may be used to reduce the likelihood that the headphone retained in the packaging insert 100 could be scuffed, scratched, or otherwise marked or damage by rubbing of the headphone against the packaging insert 100 during transportation and/or storage. The volume of material may comprise a polymer material such as polytetrafluoroethylene (PTFE), ultra-high molecular weight polyethylene (UHMW PE), or polyoxymethylene (POM). In some embodiments, the volume of material may comprise one or more pieces of woven or knit fabric material. In some embodiments, the volume of material may comprise a substantially homogenous sheet of material. The volume of material may comprise a coating disposed or otherwise formed on a least a portion of the unitary body 102 by spraying, dip-coating, painting, etc., the volume of material (or a precursor thereto) onto unitary body 102. In other embodiments, the volume of material may comprise a body separate from the unitary body 102, and may be adhered to the unitary body 102, or simply disposed between the unitary body 102 and the headphone retained in the unitary body 102.

A first fold line 110 may be defined between the integral central portion 104 and the first end portion 106, and a second fold line 112 may be defined between the integral central portion 104 and the second end portion 108. In some embodiments, the unitary body 102 may be thinned, perforated, or otherwise weakened along the first fold line 110 and the second fold line 112 so as to facilitate folding of the unitary body 102 along the first fold line 110 and the second fold line 112. The first fold line 110 and the second fold line 112 may be at least substantially coplanar and may extend at least substantially parallel to one another in some embodiments across substantially the entire width of the packaging insert 100, as shown in FIGS. 1 through 3. The central portion 104 of the unitary body 102 may include a planar peripheral area 114. The first fold line 110 may extend along a peripheral boundary at one end of the planar peripheral area 114, and the second fold line 112 may extend along another peripheral boundary at an opposing end of the planar peripheral area 114. The fold lines 110, 112 may be formed by creating perforations, molding a groove, or reducing the thickness of the packaging insert 100 along a desired fold path to create a natural and consistent bending point when rotational force is applied to the first and second end portions 106, 108 in a direction toward the integral central portion 104.

Each of the central portion 104, the first end portion 106, and the second end portion 108 includes one or more three-dimensional features having geometries configured to cooperate with (e.g., mate or conform to) features of a headphone so as to retain and protect the headphone within the packaging insert 100, as discussed in further detail below. The unitary body 102 of the packaging insert 100 may be formed using a stamping or molding process, for example. The unitary body may comprise a non-planar, three-dimensional sheet of material that defines complementary protrusions and recesses on opposing sides of the unitary body 102. The non-planar, three-dimensional sheet of material may have a generally uniform thickness in some embodiments.

The front side of the unitary body 102 (shown in FIG. 1) is the side on which the headphone is disposed when the packaging insert 100 is folded around the headphone, as discussed in further detail below.

As shown in FIGS. 1 and 3, the central portion 104 of the unitary body 102 includes a central support feature 120 defined by a protrusion on the front side of the unitary body 102 and a complementary recess on the back side of the unitary body 102. The central support feature 120 is designed and configured to be disposed centrally within and provide support to a headphone to be mounted therein. The central support feature 120 may include an arcuate surface 122 having a size and shape complementary to a headband of a headphone that includes two earphones attached to opposite ends of the headband. The headband may be configured to rest over the top of the head of a person wearing the headphone. Thus, the arcuate surface 122 may have a geometry similar to that of a portion of the head of a person. The central support feature 120 also may include and define two ear cup receptacle cavities 124A, 124B on the front side of the unitary body 102 that are sized and configured to receive ear cups 204A, 204B (FIGS. 6 and 7) of the earphones when the headphone is disposed around and supported by the central support feature 120.

Referring to FIG. 1, the first end portion 106 of the unitary body 102 includes a headband retaining feature 130. The headband retaining feature 130 includes a concave headband recess 132 formed in a protrusion on the front side of the unitary body 102 that has a size and shape generally complementary to a portion (e.g., a top, central portion) of the arcuate surface 122 of the central support feature 120. When a headphone is mounted around the central support feature 120 and the first end portion 106 is rotated relative to the central portion 104 by folding the unitary body 102 along the first fold line 110 as discussed below, the headband of the headphone is disposed and retained between the complementarily-shaped headband retaining feature 130 (e.g., a concave recess) and arcuate surface 122 to securely retain the headphone within the folded unitary body 102 and impede movement of the headphone therein.

With continued reference to FIG. 1, the second end portion 108 of the unitary body 102 includes a headphone retaining feature 140. The headphone retaining feature 140 includes two concave ear cup recesses 142A, 142B formed in a protrusion on the front side of the unitary body 102 that have sizes and shapes generally complementary to lower portions of the ear cups 204A, 204B (FIGS. 6 and 7) of the headphone configured to be supported within the packaging insert 100. When a headphone is mounted around the central support feature 120 and the second end portion 108 is rotated relative to the central portion 104 by folding the unitary body 102 along the second fold line 112 as discussed below, each ear cup of the headphone may be disposed partially within one of the ear cup receptacle cavities 124A, 124B of the central support feature 120 and a corresponding one of the concave headphone recesses 142A, 142B in the headphone retaining feature 140. Thus, the headphones are retained between the central support feature 120 of the central portion 104 and the headphone retaining feature 140 of the second end portion 108 in the folded configuration of the unitary body 102 to further retain and protect the headphone therein and prevent relative movement between the headphone and the packaging insert 100 during transport and display.

The first end portion 106 optionally may further include an alignment feature 146 having one or more surfaces that are complementary in size and shape to a portion of the central support feature 120, such as the arcuate surface 122, as shown in FIGS. 1 and 3. As the first end portion 106 is rotated relative to the central portion 104 by folding the unitary body 102 along the first fold line 110, the alignment feature 146 may abut against or be disposed proximate arcuate surface 122 to align the first end portion 106 with the central portion 104 and provide further structural rigidity to the folded unitary body 102 to protect the headphone retained therein.

Similarly, the second end portion 108 optionally may further include an alignment feature 144 having one or more surfaces that are complementary in size and shape to a portion of the central support feature 120, such as a lower nose portion 126 disposed between the ear cup receptacle cavities 124A, 124B, as shown in FIGS. 1 and 3. As the second end portion 108 is rotated relative to the central portion 104 by folding the unitary body 102 along the second fold line 112, the alignment feature 144 may abut against or be disposed proximate the lower nose portion 126 to align the second end portion 108 with the central portion 104 and provide further structural rigidity to the folded unitary body 102 to protect the headphone retained therein.

Figure 4:
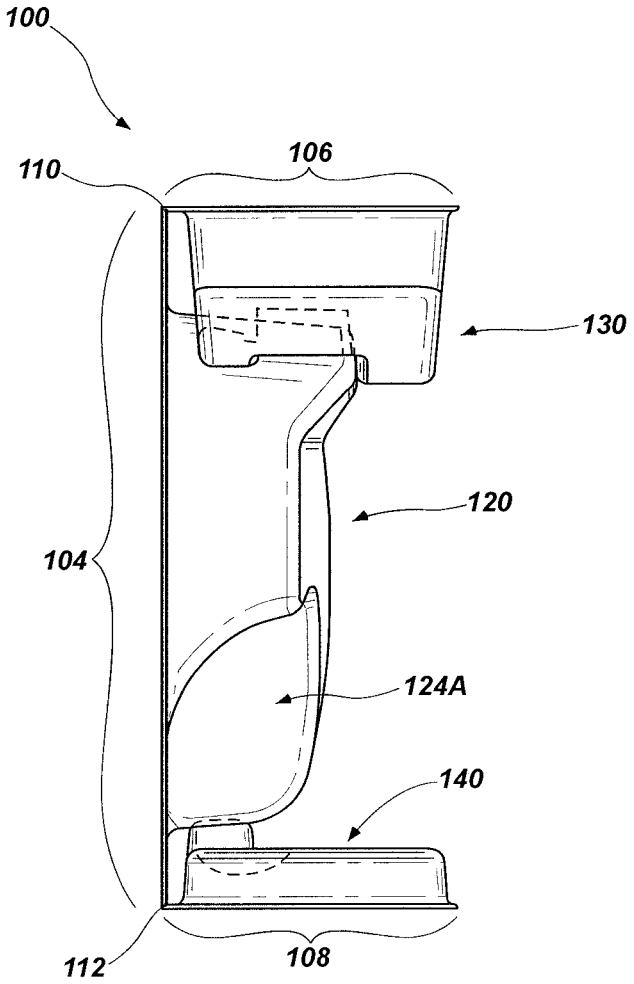
FIG. 4 is a side view of the packaging insert of FIG. 1 in a folded configuration.
Figure 5:
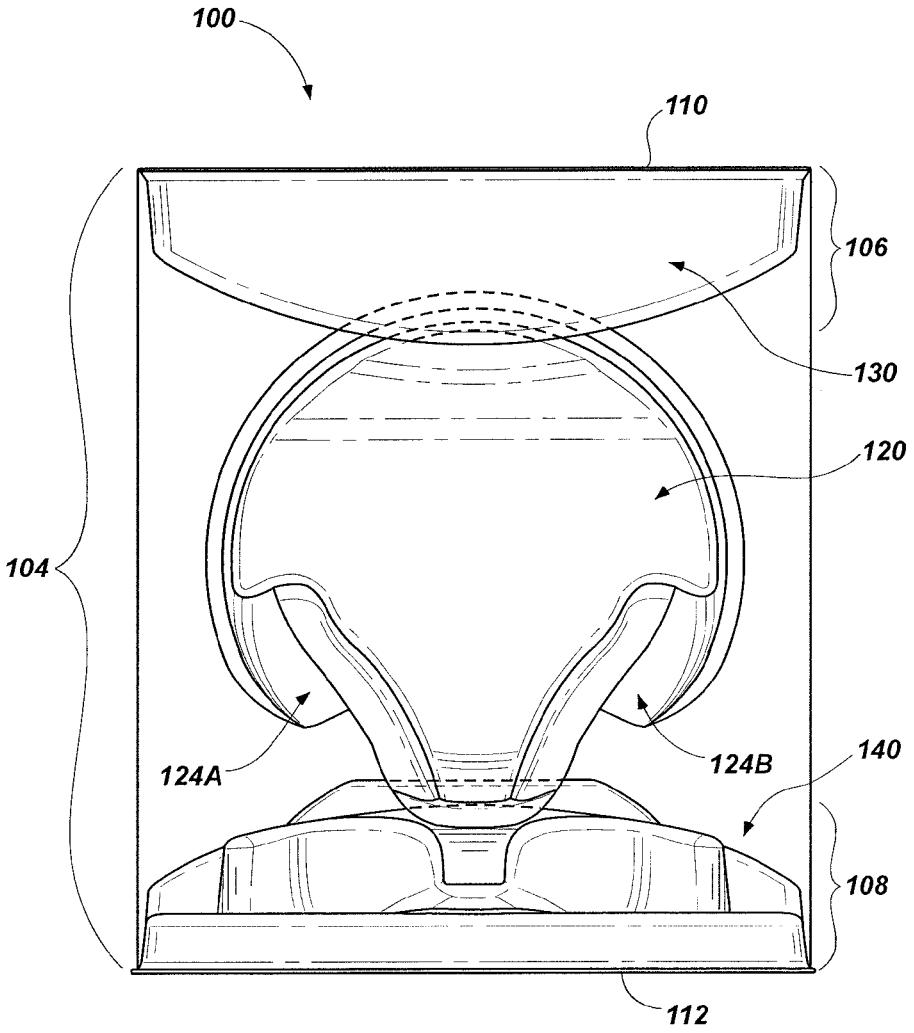
FIG. 5 is a front view of the packaging insert of FIG. 1 in the folded configuration of FIG. 4.

FIGS. 4 and 5 are side and front views, respectively, illustrating the packaging insert 100 in the folded configuration as described above with reference to FIGS. 1 through 3.

Figure 6:
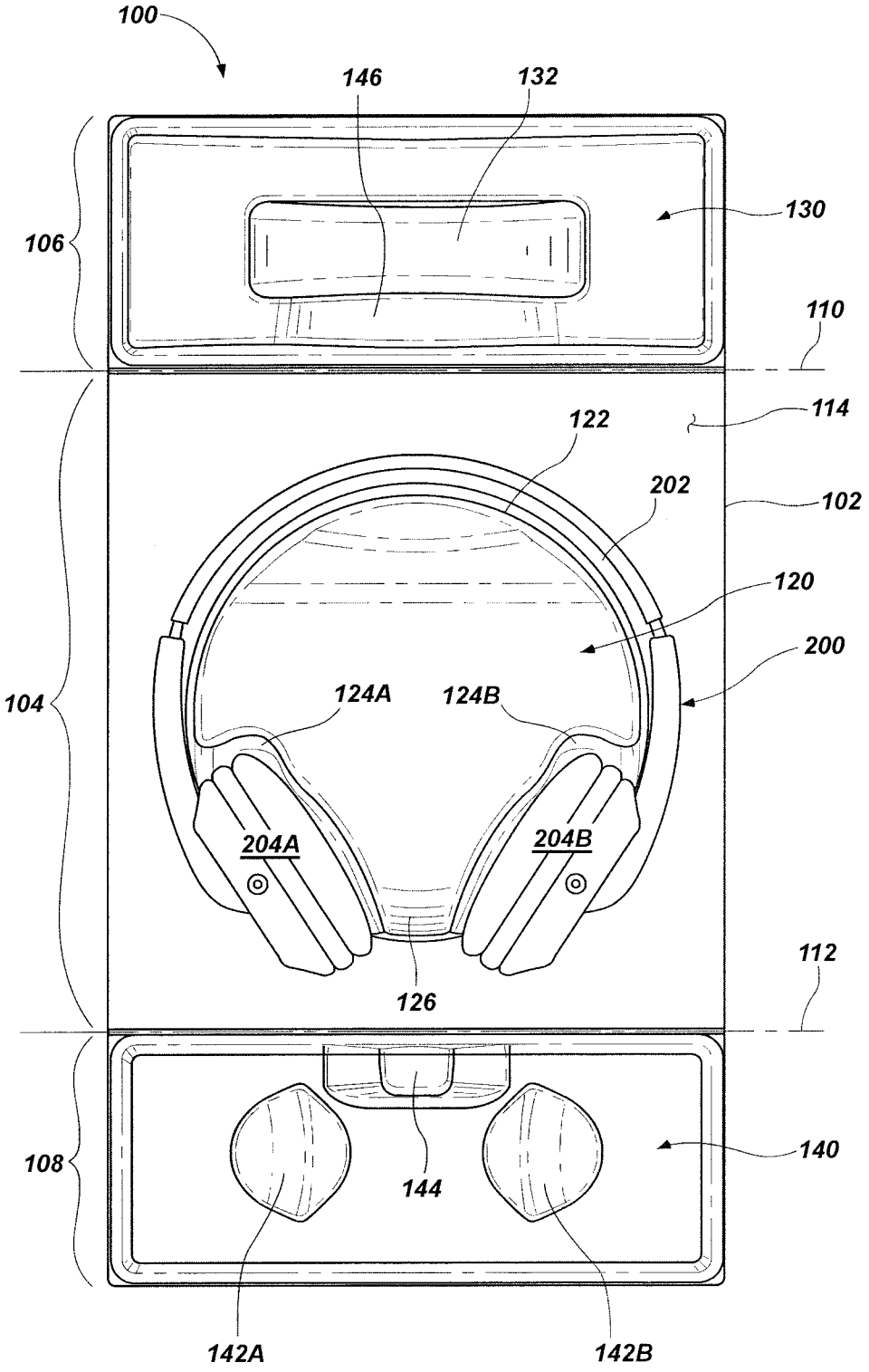
FIG. 6 is a plan view of a front side of the packaging insert of FIG. 1 with a headphone resting thereon.

Use of the packaging insert 100 to package a headphone is described below with reference to FIGS. 6 and 7. FIG. 6 is a plan view of the front side of the packaging insert 100, which is that side also illustrated in FIG. 1. As shown in FIG. 6, a headphone 200 may be positioned on the packaging insert 100. For example, the headphone 200 may be mounted around the central support feature 120 on the central portion 104 of the unitary body 102, such that a headband 202 of the headphone 200 extends around the periphery of the central support feature 120 adjacent the arcuate surface 122 thereof. A first ear cup 204A of the headphone 200 may be disposed within the first ear cup receptacle cavity 124A of the central support feature 120, and a second ear cup 204B of the headphone 200 may be disposed within the second ear cup receptacle cavity 124B of the central support feature 120.

Optionally, before or after positioning the headphone 200 around the central support feature 120, a paper or cardboard insert (not shown) may be disposed on the central portion 104 around the central support feature 120, such as to cover at least a portion of the planar peripheral area 114. Such an insert may not be transparent, and optionally may be provided with printed graphics and/or text thereon. Wires, batteries, accessories, and/or printed materials (e.g., warranty materials, instructions for use, etc.) may be positioned behind the paper or cardboard insert on an opposite side thereof relative to the headband 202 and ear cups 204A, 204B so as to be hidden from view in the final packaged configuration (see, e.g., FIG. 8).

Figure 7:
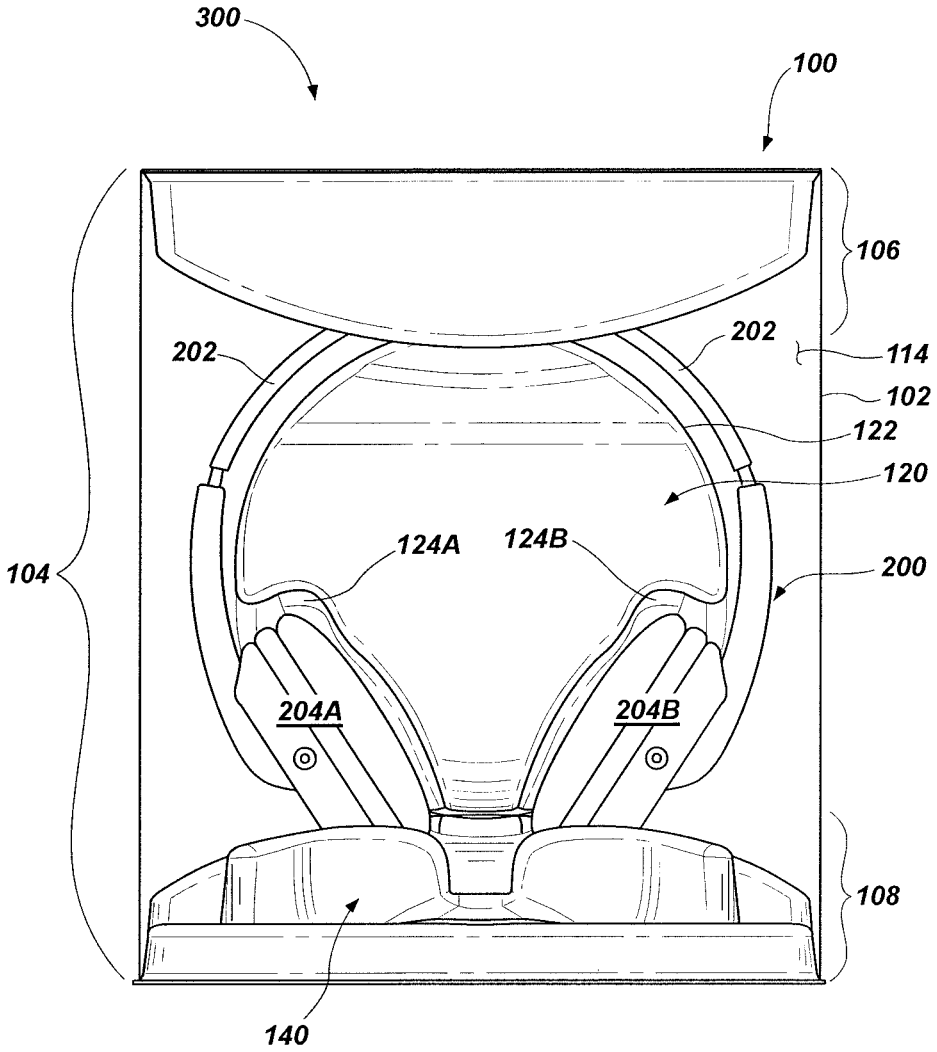
FIG. 7 is a front view of the packaging insert shown in FIG. 7 folded around the headphone.

After mounting the headphone 200 around the central support feature 120, the unitary body 102 of the packaging insert 100 may be folded along each of the first fold line 110 and the second fold line 112 by rotating the first end portion 106 and the second end portion 208 relative to the central portion 104 of the unitary body 102 to provide a packaged headphone assembly 300 shown in FIG. 7. In the packaged headphone assembly 300 shown in FIG. 7, the headphone 200 is retained and protected within the folded packaging insert 100. In particular, the headband 202 of the headphone 200 is disposed between the arcuate surface 122 of the central support feature 120 and the surfaces of the headband retaining feature 130 within the concave headband recess 132. Similarly, the ear cups 204A, 204B of the headphone 200 are respectively disposed within the ear cup receptacle cavities 124A, 124B of the central support feature 120 and the concave headphone recesses 142A, 142B of the headphone retaining feature 140. In this configuration, surfaces of the headphone abut against, and are supported and protected by, adjacent surfaces of each of the central support feature 120, the headband retaining feature 130, and the ear cup retaining feature 140. Additionally, the headphone 200 may not be removed from the folded packaging insert 100 without unfolding, deforming, or damaging the packaging insert 100. Thus, to remove the headphone 200 from the folded packaging insert 100, the folded packaging insert is first unfolded.

Figure 8:
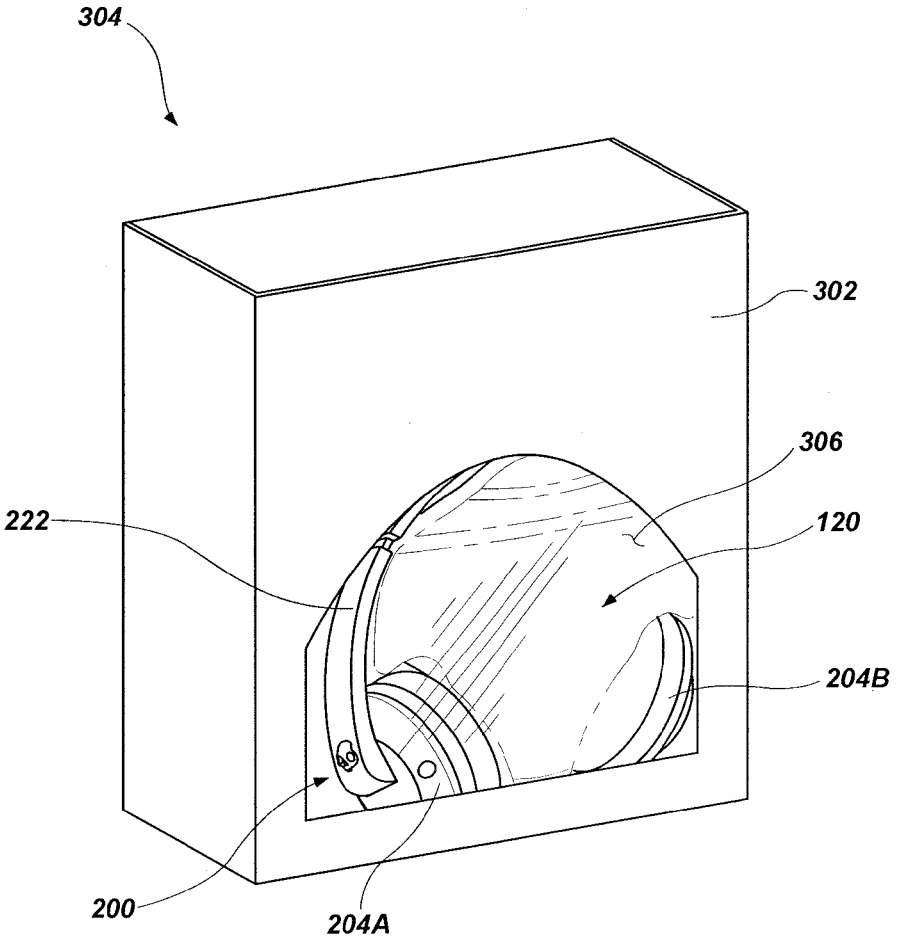
FIG. 8 illustrates the headphone and folded packaging insert of FIG. 7 disposed within a rectangular box container.

Referring to FIG. 8, the packaged headphone assembly 300 of FIG. 7 may be inserted into a container 302 to provide a finished packaged headphone assembly 304 suitable for shipment, storage, and/or display for sale. As shown in FIG. 8, the container 302 may comprise a generally rectangular box. In some embodiments, at least a portion of the container 302 may be transparent to allow at least a portion of the headphone 200 to be viewed through the container 302 when the packaging insert 100 and the headphone 200 retained therein are disposed within the container 302 and the container 302 is closed. For example, a majority of the container 302 may comprise a paper or cardboard box, and a plastic transparent window 306 may be provided in one or more walls of the box.

Although the packaging insert 100 described hereinabove includes three integral portions separated by fold lines, additional embodiments of the packaging insert 100 may include less or more integral portions with fold lines there between. For example, in additional embodiments, the packaging insert 100 may only include the central portion 104 and the first end portion 106, and may not include the second end portion 108. In yet further embodiments, the packaging insert 100 may only include the central portion 104 and the second end portion 108, and may not include the first end portion 106. In such embodiments, separately formed insert components, similar to the integral portions described herein but separate from the central portion 104, optionally may be employed in conjunction with a foldable packaging insert as described herein. In additional embodiments, a packaging assembly may include three or more separately formed packaging inserts similar to the central portion 104 and the end portions 106, 108 described herein but separate from each other. In such embodiments, the separately formed packaging inserts may be complementarily coupled together to retain a headphone and inserted into another container, such as a rectangular packaging box, similar to the description above but without folding the packaging inserts relative to one another. In other embodiments, one of the end portions 106 and/or 108 may not include protrusions or features that complement the central support feature 120. Such an end portion may be generally flat and configured to rest against and support an adjacent surface of a container 308 in which the insert 100 is to be disposed. Further, the packaging insert 100 as described herein optionally could include additional integral side portions on the lateral sides of the central portion 104, which integral side portions could be configured to fold relative to the central portion 104 so as to provide lateral support and protection to a headphone 200 retained therein.

Additional non-limiting examples of embodiments of the disclosure are set forth below.

Embodiment 1

A packaging insert for a headphone, comprising: a unitary body including a first integral portion and a second integral portion adjoining the first integral portion along a fold line, the first integral portion including a central support feature sized and configured to be disposed within and provide support to a headphone to be packaged using the packaging insert, the second integral portion including a retaining feature sized and configured to cooperate with the central support feature of the first integral portion to retain a portion of a headphone to be packaged using the packaging insert when the first integral portion and the second integral portion are folded relative to one another along the fold line.

Embodiment 2

The packaging insert of Embodiment 1, wherein the retaining feature of the second integral portion of the unitary body comprises a headband retaining feature sized and configured to cooperate with the central support feature of the first integral portion to retain a headband of a headphone to be packaged using the packaging insert when the first integral portion and the second integral portion are folded relative to one another along the fold line.

Embodiment 3

The packaging insert of Embodiment 2, wherein the central support feature comprises an arcuate surface having a size and shape complementary to a size and shape of at least a portion of a headband of a headphone to be packaged using the packaging insert.

Embodiment 4

The packaging insert of Embodiment 3, wherein the headband retaining feature of the second integral portion of the unitary body comprises another arcuate surface having a size and shape complementary to a size and shape of at least a portion of a headband of a headphone to be packaged using the packaging insert.

Embodiment 5

The packaging insert of any one of Embodiments 1 through 4, wherein the retaining feature of the second integral portion of the unitary body comprises an ear cup retaining feature sized and configured to cooperate with the central support feature of the first integral portion to retain an ear cup of the headphone to be packaged using the packaging insert when the first integral portion and the second integral portion are folded relative to one another along the fold line.

Embodiment 6

The packaging insert of Embodiment 5, wherein the central support feature comprises an ear cup receptacle cavity having a size and shape configured to receive and support therein at least a portion of the ear cup of the headphone to be packaged using the packaging insert.

Embodiment 7

The packaging insert of Embodiment 6, wherein the ear cup retaining feature of the second integral portion of the unitary body comprises a concave ear cup recess having a size and shape configured to receive and support therein at least a portion of the ear cup of the headphone to be packaged using the packaging insert.

Embodiment 8

The packaging insert of any one of Embodiments 1 through 7, further comprising a third integral portion adjoining the first integral portion along another fold line, wherein the first integral portion comprises a central portion of the unitary body, the second integral portion comprises a first end portion of the unitary body disposed at a first end of the unitary body, and the third integral portion comprises a second end portion of the unitary body disposed at an opposing second end of the unitary body from the first end of the unitary body.

Embodiment 9

The packaging insert of Embodiment 8, wherein the retaining feature of the second integral portion of the unitary body comprises a headband retaining feature sized and configured to cooperate with the central support feature of the first integral portion to retain a headband of the headphone to be packaged using the packaging insert when the first integral portion and the second integral portion are folded relative to one another along the fold line.

Embodiment 10

The packaging insert of Embodiment 9, wherein the third integral portion of the unitary body comprises an ear cup retaining feature sized and configured to cooperate with the central support feature of the first integral portion to retain an ear cup of a headphone to be packaged using the packaging insert when the first integral portion and the third integral portion are folded relative to one another along the another fold line.

Embodiment 11

The packaging insert of any one of Embodiments 1 through 10, wherein the unitary body comprises paper pulp material.

Embodiment 12

The packaging insert of Embodiment 11, further comprising a volume of material disposed over at least a portion of the unitary body, the volume of material comprising a material exhibiting a reduced coefficient of friction relative to the paper pulp material.

Embodiment 13

The packaging insert of Embodiment 12, wherein the volume of material comprises a coating disposed on a least a portion of the unitary body.

Embodiment 14

A method of packaging a headphone, comprising: positioning a headphone on a headphone support feature of a packaging insert having a unitary body; and folding the unitary body along a fold line to rotate an integral end portion of the unitary body relative to the headphone support feature to secure at least a portion of the headphone between the integral end portion and the headphone support feature.

Embodiment 15

The method of Embodiment 14, further comprising inserting the folded unitary body with the headphone therein into a container.

Embodiment 16

The method of Embodiment 15, further comprising selecting at least a portion of the container to include a transparent window through which at least a portion of the headphone may be viewed when the folded unitary body and the headphone are disposed in the container.

Embodiment 17

The method of any one of Embodiments 14 through 16, further comprising folding the unitary body along another fold line to rotate another integral end portion of the unitary body relative to the headphone support feature to secure at least another portion of the headphone between the another integral end portion and the headphone support feature.

Embodiment 18

The method of any one of Embodiments 14 through 17, further comprising: selecting the unitary body to comprise paper pulp material; and providing a volume of material between at least a portion of the unitary body and the headphone, the volume of material comprising a material exhibiting a reduced coefficient of friction relative to the paper pulp material.

Embodiment 19

The method of Embodiment 18, further comprising selecting the volume of material to comprise a coating disposed on a least a portion of the unitary body.

Embodiment 20

A packaged headphone assembly, comprising: a packaging insert; and a headphone retained within the packaging insert; wherein the packaging insert comprises a unitary body including a first integral portion folded relative to a second integral portion along a fold line there between, the first integral portion including a central support feature partially surrounded by and supporting the headphone, the second integral portion including a retaining feature cooperating with the central support feature of the first integral portion to retain a portion of the headphone within the folded unitary body between the first integral portion and the second integral portion.

Embodiment 21

The packaged headphone assembly of Embodiment 20, further comprising a container, the packaging insert with the headphone retained therein disposed within the container.

Embodiment 22

The packaged headphone assembly of Embodiment 20 or Embodiment 21, wherein the central support feature comprises an arcuate surface having a size and shape complementary to a size and shape of at least a portion of a headband of the headphone.

Embodiment 23

The packaged headphone assembly of Embodiment 22, wherein the retaining feature of the second integral portion comprises a headband retaining feature including another arcuate surface having a size and shape complementary to a size and shape of at least a portion of the headband of the headphone.

Embodiment 24

The packaged headphone assembly of any one of Embodiments 20 through 23, wherein the retaining feature of the second integral portion of the unitary body comprises an ear cup retaining feature sized and configured to cooperate with the central support feature of the first integral portion to retain an ear cup of the headphone between the first integral portion and the second integral portion.

Embodiment 25

The packaged headphone assembly of any one of Embodiments 20 through 24, wherein the packaging insert further comprises a third integral portion adjoining the first integral portion along another fold line, wherein the first integral portion comprises a central portion of the unitary body, the second integral portion comprises a first end portion of the unitary body disposed at a first end of the unitary body, and the third integral portion comprises a second end portion of the unitary body disposed at an opposing second end of the unitary body from the first end of the unitary body.

The embodiments of the invention described above do not limit the scope the invention, since these embodiments are merely examples of embodiments of the invention, which is defined by the scope of the appended claims and their legal equivalents. Any equivalent embodiments are intended to be within the scope of this invention. Indeed, various modifications of the disclosed embodiments, such as alternate useful combinations of the described elements of the embodiments, will become apparent to those skilled in the art from the description. Such modifications are also intended to fall within the scope of the appended claims.

What is claimed is:

1. A packaged headphone assembly, comprising:

a container, at least a portion of the container comprising transparent material;

a packaging insert disposed within the container; and a headphone retained within the packaging insert;

wherein the packaging insert comprises:

a unitary body including:

a first integral portion folded relative to and adjoining a second integral portion along a first fold line therebetween, the first integral portion including a central support feature partially surrounded by and supporting the headphone and a planar peripheral area surrounding the central support feature, wherein the first fold line extends along a first peripheral boundary of the first integral portion at a first end of the planar peripheral area of the first integral portion, the second integral portion including an ear cup retaining feature defining a concave ear cup recess therein, the ear cup retaining feature cooperating with the central support feature of the first integral portion to retain an ear cup of the headphone within the folded unitary body between the first integral portion and the second integral portion; and a third integral portion folded relative to and adjoining the first integral portion along a second fold line that extends along a second peripheral boundary of the first integral portion at a second opposing end of the planar peripheral area of the first integral portion, wherein the second fold line is coplanar and parallel to the first fold line, the third integral portion being located on a side of the first integral portion opposing the second integral portion, the third integral portion comprising a headband retaining feature including an arcuate surface having a size and shape complementary to a size and shape of at least a portion of a headband of the headphone, wherein at least a portion of the headphone is visible through the container.

2. The packaged headphone assembly of claim 1, wherein the central support feature comprises an ear cup receptacle cavity having a size and shape configured to receive and support therein at least a portion of the ear cup of the headphone to be packaged using the packaging insert.

3. The packaged headphone assembly of claim 1, wherein the headband retaining feature of the third integral portion of the unitary body is sized and configured to cooperate with the central support feature of the first integral portion to retain the headphone when the first integral portion and the third integral portion are folded relative to one another along the fold line.

4. The packaged headphone assembly of claim 1, wherein the unitary body comprises paper pulp material.

5. The packaged headphone assembly of claim 4, further comprising a volume of material disposed over at least a portion of the unitary body, the volume of material comprising a material exhibiting a reduced coefficient of friction relative to the paper pulp material.

6. The packaged headphone assembly of claim 5, wherein the volume of material comprises a coating disposed on at least a portion of the unitary body.

7. The packaged headphone assembly of claim 1, wherein the central support feature comprises another arcuate surface having a size and shape complementary to a size and shape of at least a portion of the headband of the headphone.

8. The packaged headphone assembly of claim 1, wherein the at least a portion of the headband of the headphone is disposed between the arcuate surface of the headband retaining feature of the third integral portion and the another arcuate surface of the central support feature of the first integral portion.

9. The packaged headphone assembly of claim 1, wherein the at least a portion of the container comprising transparent material comprises a window.

10. The packaged headphone assembly of claim 1, wherein a majority of the container comprises cardboard and the at least a portion of the container comprising transparent material comprises at least one window in at least one wall of the container.

11. The packaged headphone assembly of claim 1, wherein the container comprises a rectangular box.

12. The packaged headphone assembly of claim 1, wherein the third integral portion further comprises a first alignment feature having at least one surface that is complementary in size and shape to at least a portion of the central support feature of the first integral portion, the first alignment feature of the third integral portion abutting against the at least a portion of the central support feature of the first integral portion and aligning the third integral portion with the first integral portion.

13. The packaged headphone assembly of claim 1, wherein the second integral portion further comprises a second alignment feature having at least one surface that is complementary in size and shape to at least a portion of the central support feature of the first integral portion, the second alignment feature of the second integral portion abutting against the at least a portion of the central support feature of the first integral portion and aligning the third integral portion with the first integral portion.

14. A method of packaging a headphone, comprising:

positioning the headphone on a central support feature of a packaging insert having a unitary body including a first integral portion and a second integral portion adjoining the first integral portion along a first fold line, the first integral portion including the central support feature, the central support feature sized and configured to be disposed centrally within and provide support to the headphone to be packaged using the packaging insert and a planar peripheral area surrounding the central support feature, wherein the first fold line extends along a first peripheral boundary of the first integral portion at a first end of the planar peripheral area of the first integral portion, the second integral portion including an ear cup retaining feature defining a concave ear cup recess therein, and the second integral portion are folded relative to one another along the first fold line, the unitary body further including a third integral portion adjoining the first integral portion along a second fold line that extends along a second peripheral boundary of the first integral portion at a second opposing end of the planar peripheral area of the first integral portion, wherein the second fold line is coplanar and parallel to the first fold line, the third integral portion being located on a side of the first integral portion opposing the second integral portion, the third integral portion comprising a headband retaining feature sized and configured to cooperate with the central support feature of the first integral portion to retain the headphone of the headphone to be packaged using the packaging insert when the first integral portion and the third integral portion are folded relative to one another along the second fold line;

folding the unitary body along the first fold line to rotate the second integral portion of the unitary body relative to the central support feature to secure an ear cup of the headphone at least partially within the concave ear cup recess;

folding the unitary body along the second fold line to rotate the third integral portion of the unitary body relative to the central support feature to secure the headband of the headphone at least partially within the headband retaining feature; and inserting the packaging insert with the headphone positioned thereon into a container having at least a portion thereof comprising transparent material, wherein at least a portion of the headphone is visible through the container.

15. The method of claim 14, further comprising selecting at least a portion of the container to include a transparent window through which at least a portion of the headphone may be viewed when the folded unitary body and the headphone are disposed in the container.

16. The method of claim 14, further comprising:

selecting the unitary body to comprise paper pulp material; and providing a volume of material between at least a portion of the unitary body and the headphone, the volume of material comprising a material exhibiting a reduced coefficient of friction relative to the paper pulp material.

17. The method of claim 16, further comprising selecting the volume of material to comprise a coating disposed on a least a portion of the unitary body.

* * * * *